US006554033B2

(12) United States Patent
Hydon

(10) Patent No.: US 6,554,033 B2
(45) Date of Patent: Apr. 29, 2003

(54) LUGGAGE HANDLE COVER WITH ID TAG

(75) Inventor: Derek J. Hydon, Pacific Palisades, CA (US)

(73) Assignee: Ma Cher, Inc, Los Angeles, CA (US)

( * ) Notice: Subject to any disclaimer, the term of this patent is extended or adjusted under 35 U.S.C. 154(b) by 0 days.

(21) Appl. No.: 09/941,434

(22) Filed: Aug. 28, 2001

(65) Prior Publication Data

US 2003/0041937 A1 Mar. 6, 2003

(51) Int. Cl.[7] ..... A45C 13/18; A45C 13/28

(52) U.S. Cl. ..... 150/155; 150/154; 190/102; 16/411; 40/6

(58) Field of Search ..... 150/154, 155; 190/26, 39, 101, 102, 115; 16/411; 383/15; 40/6, 661.12

(56) References Cited

U.S. PATENT DOCUMENTS

| | | | | | |
|---|---|---|---|---|---|
| 462,667 | A | * | 11/1891 | Goldbeck | 40/10 |
| 1,008,604 | A | * | 11/1911 | Lake | 150/155 X |
| 1,277,785 | A | * | 9/1918 | Urband | 190/102 |
| 2,274,605 | A | * | 2/1942 | Hoffmeister | 190/115 X |
| 2,429,019 | A | * | 10/1947 | Freed | 150/154 X |
| 2,540,718 | A | * | 2/1951 | Duskin | 40/10 |
| 2,712,336 | A | * | 7/1955 | Casselman | 383/15 X |
| 2,747,310 | A | * | 5/1956 | Tierney | 190/115 X |
| 3,999,639 | A | * | 12/1976 | Walters | 190/102 |
| D246,591 | S | * | 12/1977 | Sollazzi | D19/13 |
| 4,262,385 | A | * | 4/1981 | Norman | 16/114.1 |
| 4,531,312 | A | * | 7/1985 | Stoddart | 40/16 X |
| 4,828,081 | A | * | 5/1989 | Nordstrom et al. | 190/102 |
| 4,830,153 | A | * | 5/1989 | Saliba | 190/102 |
| 4,966,279 | A | * | 10/1990 | Pearcy | 190/100 X |
| 5,293,975 | A | * | 3/1994 | Howorka | 190/26 |
| 5,722,672 | A | * | 3/1998 | Frederick | 280/33.992 |
| 6,065,764 | A | * | 5/2000 | Moseley | 150/154 X |
| 6,401,889 | B1 | * | 6/2002 | McCleskey | 190/102 |

FOREIGN PATENT DOCUMENTS

| | | | |
|---|---|---|---|
| DE | 3343069 | * | 6/1985 |

* cited by examiner

*Primary Examiner*—Sue A. Weaver
(74) *Attorney, Agent, or Firm*—Blakely Sokoloff Taylor & Zafman

(57) ABSTRACT

A luggage handle cover having a body portion with a first end, a second end, an inner side, and an outer side. The body portion has a length and width sufficient to substantially cover a luggage handle. The luggage handle cover also has a fastening mechanism coupled to the body portion to fasten the first end and the second end and an identification display disposed on the inner side of the body portion when the body portion is arranged to substantially cover a luggage handle.

19 Claims, 4 Drawing Sheets

LUGGAGE HANDLE COVER WITH ID TAG

FIELD OF THE INVENTION

The present invention relates to luggage handle covers, more particularly luggage handle covers capable of displaying identification information.

BACKGROUND

Since the advent of modern travel, people have been able to travel great distances in only a short period of time. As such, the number and frequency of trips taken has increased rapidly. With so many people traveling with such increasing frequency, the number of suitcases and other luggage items transported by common carriers has also increased. The large number of luggage items transported creates problems for travelers when, at the end of a trip, each passenger must retrieve their luggage, which is almost inevitably mixed in with other passengers' luggage. This task becomes even more difficult due to the similar appearance of many travel bags and suitcases.

One solution is to attach an identification card to the handle of a piece of luggage to be identified. However, this leaves the owner's personal identification information, such as home address and phone number, exposed to whoever sees the identification card. Thus, the passenger's security is compromised. In addition, most identification cards are similar in appearance, which requires the passenger to manually check the identification card on each piece of luggage that looks like the passengers' luggage. Therefore, most identification cards do not securely identify the luggage item to which they are attached.

Therefore, a device is desired which will allow travelers to easily identify their luggage in a secure manner.

SUMMARY

A luggage handle cover is disclosed. In an embodiment, the handle cover has a body portion with a first end, a second end, an inner side, and an outer side, the body portion having a length and width sufficient to substantially cover a luggage handle. The handle cover also has a fastening mechanism coupled to the body portion to fasten the first end and the second end and an identification display disposed on the inner side of the body portion when the body portion is arranged to substantially cover the luggage handle.

In an embodiment, the body portion comprises any material suitable for a luggage handle cover. For instance, the body portion could comprise leather, synthetic material, waterproof material, or a fabric material. Moreover, the body portion can be made of any soft or padded material or have a gel, padding, or other resilient material disposed within or on the body portion to provide cushioning.

In an embodiment, the fastening mechanism comprises any fastener suitable for fastening the first end to the second end. For example, the fastening mechanism could comprise a hook-and-loop fastener, a button fastener, a snap fastener, or a zipper fastener.

In an embodiment, the identification display comprises any suitable identifier. For instance, the identification display could comprise a card, a monogram, an engraving, or a stamp. In addition, an embodiment also includes an indication disposed on the outer side of the body portion to indicate that the identification display is disposed on the inner side of the body portion.

BRIEF DESCRIPTION OF THE DRAWINGS

Various embodiments are illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

DETAILED DESCRIPTION

The embodiments disclosed herein overcome the problems in the existing art described above by providing a device which enables travelers to easily, yet securely, identify their luggage items. In the following description, for the purposes of explanation, numerous specific details are set forth in order to provide a thorough understanding of the various embodiments. It will be apparent, however, to one skilled in the art that the embodiments may be practiced without some of these specific details. The following description and accompanying drawings provide various examples for the purposes of illustration. However, these examples should not be construed in a limiting sense as they are merely intended to provide examples rather than to provide an exhaustive list of all possible implementations.

Figure 1:
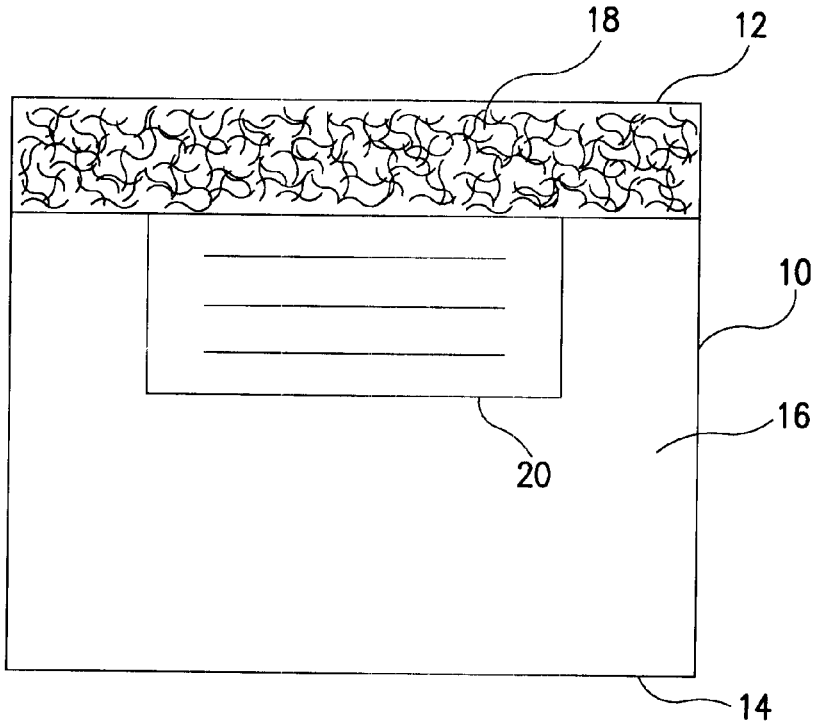
FIG. 1 is a view of the inner side of the luggage handle cover according to one embodiment.

Referring to FIG. 1, an embodiment of a luggage handle cover is shown in which the body portion 10 is laid open substantially flat for purposes of illustration. The body portion 10 has a first end 12 and a second end 14. In addition, the body portion 10 has an inner side 16 and an outer side 22 (shown in FIG. 2). In various embodiments, the body portion 10 has a length and a width sufficient to substantially cover a luggage handle. As luggage handles may vary in size and shape, it is contemplated to have a body portion 10 which could accommodate these variations.

Figure 4:
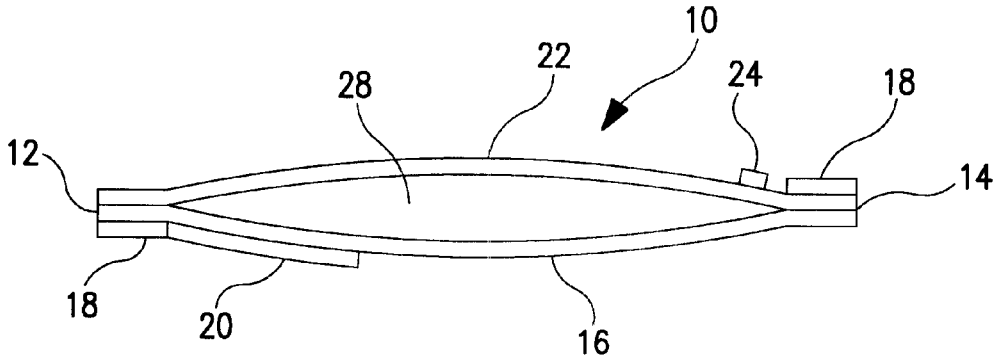
FIG. 4 is a side view of a luggage handle cover with a means for cushioning the body portion disposed within the body portion.

Furthermore, the body portion 10 may be made of any material suitable for a luggage handle cover. For instance, the body portion 10 could be made of leather, synthetic material, waterproof material, a fabric material, or any combination thereof. Although the description mainly discusses secure, reliable identification of luggage, the material chosen for the body portion 10 could also be directed towards comfort since oftentimes luggage can be heavy, especially when carried long distances through an airport terminal or a bus/train station. Besides utilizing a soft or cushioning material for the body portion 10, a means for cushioning the body portion 10 could be disposed within or on the body portion 10. FIG. 4 shows a side view of an embodiment with means for cushioning 28 disposed within body portion 10. Among others, a gel, padded material, or other resilient material could be used as a means for cushioning.

The body portion 10 also has a fastening mechanism 18 coupled to the body portion 10 to fasten the first end 12 to the second end 14. It should be noted that the fastening mechanism 18 could be any fastener suitable for fastening the first end 12 to the second end 14. For example, the fastening mechanism 18 could be a hook-and-loop fastener (otherwise known as Velcro), a button, a snap, a zipper, or any combination thereof. The embodiment shown in FIGS. 1 and 2 utilizes a hook-and-loop fastener 18 to fasten the first end 12 to the second end 14.

Figure 5:
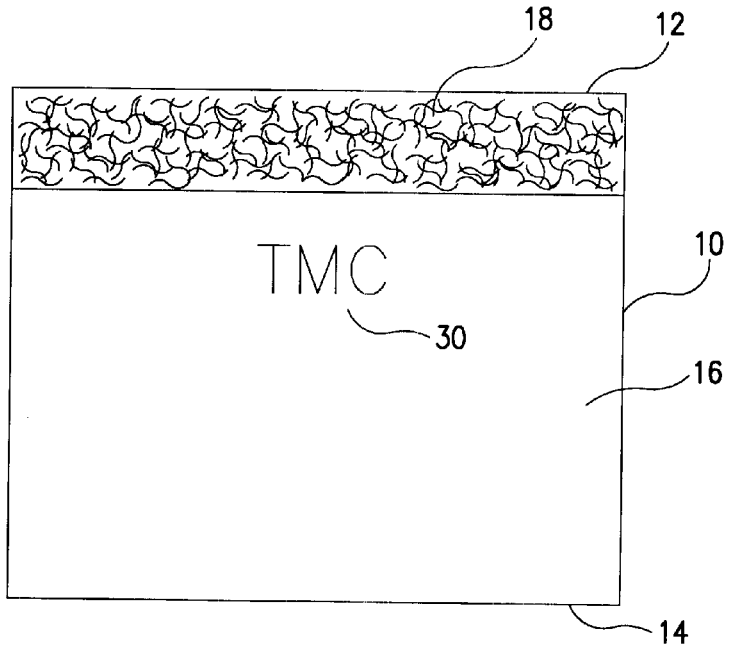
FIG. 5 is a view of the inner side of a luggage handle cover with a monogram printed on the inner side of the body portion.
Figure 6:
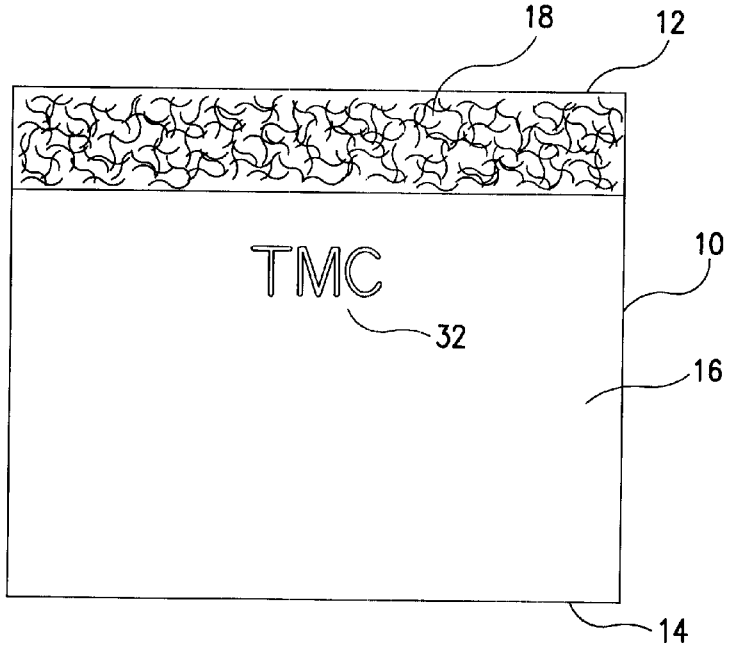
FIG. 6 is a view of the inner side of a luggage handle cover with an identifier engraved on the inner side of the body portion.
Figure 7:
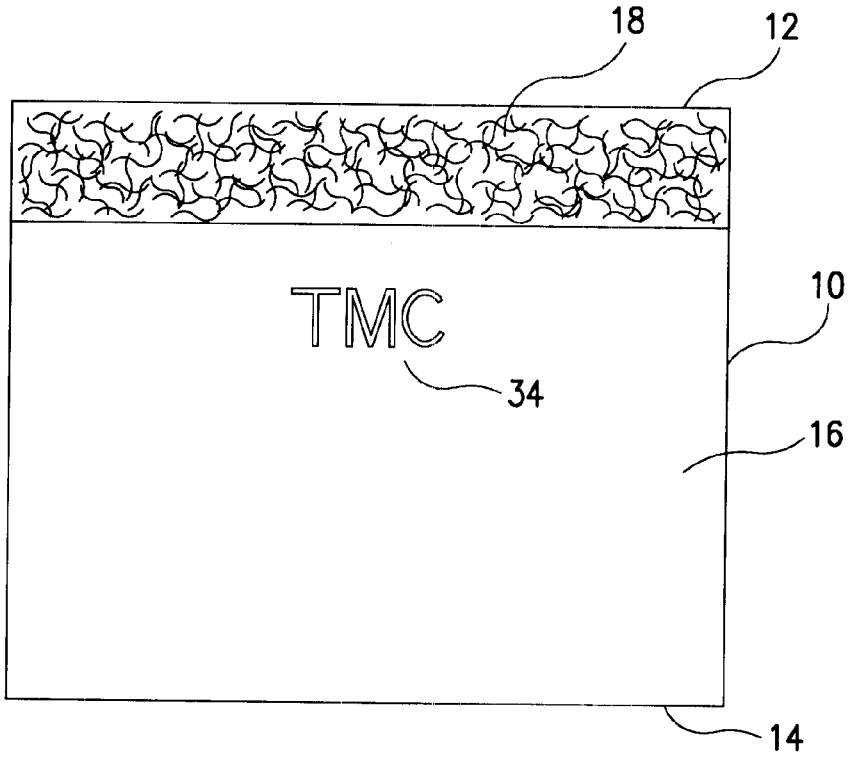
FIG. 7 is a view of the inner side of a luggage handle cover with an identifier stamped on the inner side of the body portion.

As shown in FIG. 1, an identification display 20 is disposed on the inner side 16 of the body portion 10. The location of the identification display 20 provides one of the advantages of the various embodiments described herein. Specifically, disposing the identification display 20 on the inner side 16 of the body portion 10 provides increased security since the traveler's personal information is not freely exposed. Rather, someone wishing to obtain the personal information must either take the bag in its entirety or must obtain possession of the bag in order to remove the luggage handle cover and inspect the identification display 20 located on the inner The identification display 20 can comprise any suitable identifier. For example, the identification display 20 could be a card, a printed monogram, an engraving, a stamp, or any combination thereof. FIG. 5 shows an embodiment with monogram 30 printed on inner side 16 of body portion 10. FIG. 6 shows an embodiment with identifier 32 engraved on inner side 16 of body portion 10. FIG. 7 shows an embodiment with identifier 34 stamped on inner side 16 of body portion 10.

Figure 2:
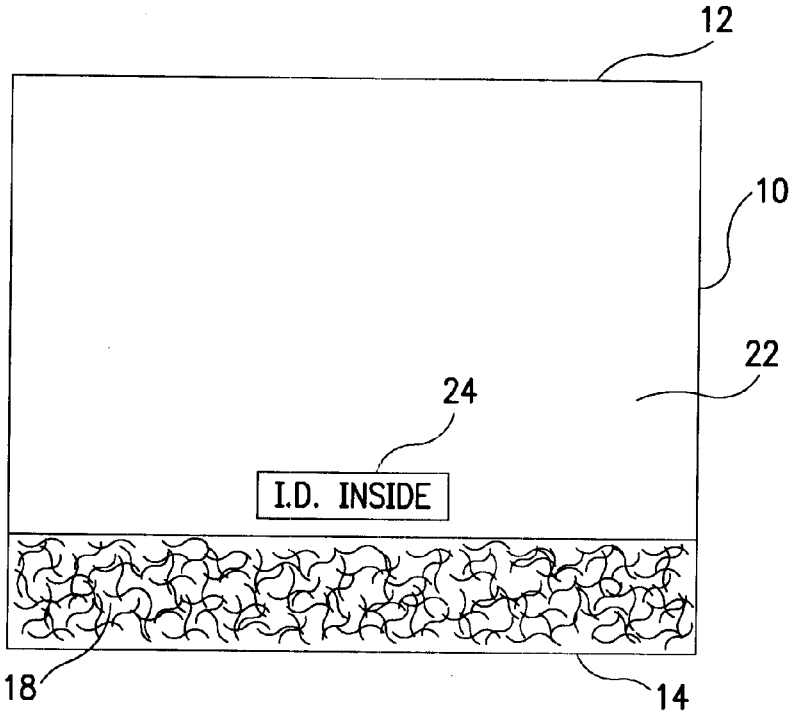
FIG. 2 is a view of the outer side of the luggage handle cover shown in FIG. 1.

FIG. 2 shows an example of an embodiment which includes an indication 24 to indicate that the identification display 20 is disposed on the inner side 16 of the body portion 10. In an embodiment, the indication 24 is relatively discrete, yet noticeable enough to notify a common carrier of the location of the identification display 20. Thus, a common carrier wishing to identify the owner of the luggage item would not automatically presume the bag had no identification. side 16.

Figure 3:
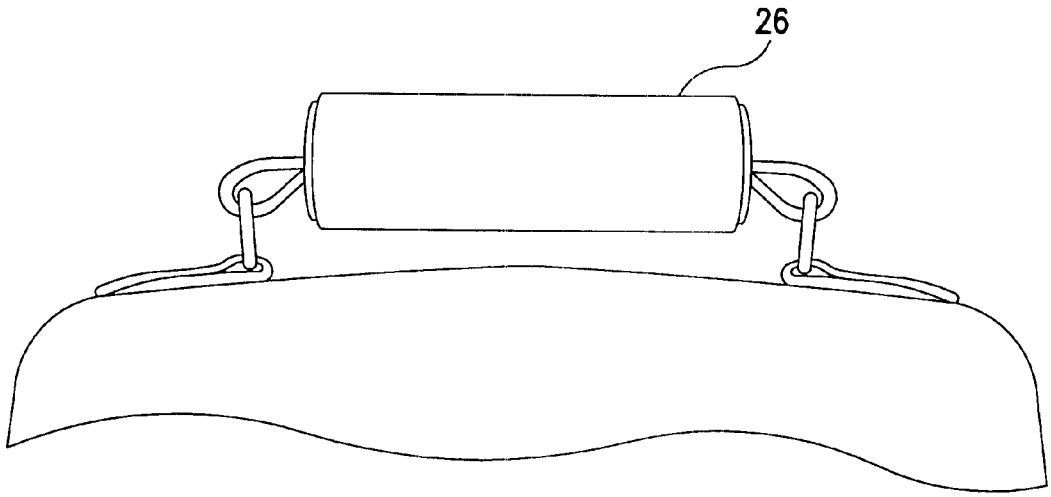
FIG. 3 is side view of an embodiment as it would be disposed around a luggage handle.
Figure 8:
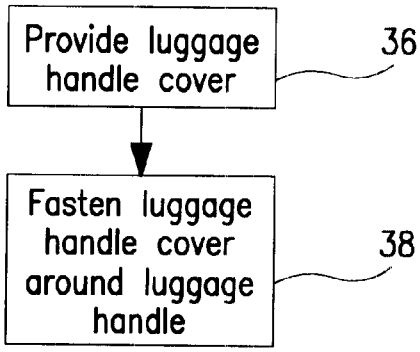
FIG. 8 is a flow chart showing a method of attaching a luggage handle cover to a luggage handle.

Using any of the various embodiments described above, a traveler could identify a piece of luggage by fastening the luggage handle cover around the handle of the luggage to be identified. FIG. 8 shows a method of attaching a luggage handle cover to a luggage handle. At box 36, a luggage handle cover is provided. For example, the luggage handle cover may correspond to the embodiment shown in FIGS. 1 and 2. At box 38, the luggage handle cover is fastened around a luggage handle. Once fastened, the luggage handle cover 26 would appear similar to that shown in FIG. 3.

The disclosed embodiments are beneficial to groups as well as to individual travelers. For instance, an entire group may use the same color or style of luggage handle cover for easy collection of the group's luggage from a common collection area. The group's luggage may then be sorted in a more secure environment.

It is to be understood that even though numerous characteristics and advantages of various embodiments have been set forth in the foregoing description, together with details of the structure and function, this disclosure is illustrative only. Changes may be made in detail, especially matters of structure and management of parts, without departing from the scope of the embodiments as expressed by the broad general meaning of the terms of the appended claims

We claim:

1. A luggage handle cover comprising:

a body portion comprising a first end, a second end, an inner side, and an outer side, the body portion having a length and a width sufficient to substantially cover a luggage handle;

a fastening mechanism coupled to the body portion to fasten the first end to the second end;

an identification display disposed on the inner side of the body portion when the body portion is arranged to substantially cover a luggage handle; and an indication disposed on the outer side of the body portion when the body portion is arranged to substantially cover the luggage handle, the indication to indicate that the identification display is disposed on the inner side of the body portion.

2. The luggage handle cover of claim 1, further comprising a means for cushioning the body portion.

3. The luggage handle cover of claim 1, wherein the body portion comprises any material suitable for a luggage handle cover.

4. The luggage handle cover of claim 3, wherein the body portion comprises leather.

5. The luggage handle cover of claim 3, wherein the body portion comprises a synthetic material.

6. The luggage handle cover of claim 3, wherein the body portion comprises a waterproof material.

7. The luggage handle cover of claim 3, wherein the body portion comprises a fabric material.

8. The luggage handle cover of claim 1, wherein the fastening mechanism comprises any fastener suitable for fastening the first end to the second end.

9. The luggage handle cover of claim 8, wherein the fastening mechanism comprises a hook-and-loop fastener.

10. The luggage handle cover of claim 8, wherein the fastening mechanism comprises a button fastener.

11. The luggage handle cover of claim 8, wherein the fastening mechanism comprises a snap fastener.

12. The luggage handle cover of claim 8, wherein the fastening mechanism comprises a zipper fastener.

13. The luggage handle cover of claim 1, wherein the identification display comprises any suitable identifier.

14. The luggage handle cover of claim 13, wherein the identification display comprises a card.

15. The luggage handle cover of claim 13, wherein the identification display comprises a monogram printed on the inner side of the body portion.

16. The luggage handle cover of claim 13, wherein the identification display comprises an identifier engraved on the inner side of the body portion.

17. The luggage handle cover of claim 13, wherein the identification display comprises an identifier stamped on the inner side of the body portion.

18. A luggage handle cover comprising:

a body portion comprising a synthetic material including a first end, a second end, an inner side, and an outer side, the body portion having a length and a width sufficient to substantially cover a luggage handle;

a hook-and-loop fastener coupled to the body portion to fasten the first end to the second end;

an identification card disposed on the inner side of the body portion when the body portion is arranged to substantially cover the luggage handle; and an indication disposed on the outer side of the body portion when the body portion is arranged to substantially cover the luggage handle, the indication to indicate that the identification display is disposed on the inner side of the body portion.

19. A method for identifying an article of luggage comprising:

providing a luggage handle cover comprising:

a body portion comprising a first end, a second end, an inner side, and an outer side, the body portion having a length and a width sufficient to substantially cover a luggage handle;

a fastening mechanism coupled to the body portion for fastening the first end to the second end;

an identification display disposed on the inner side of the body portion when the body portion is arranged to substantially cover a luggage handle; and an indication disposed on the outer side of the body portion when the body portion is arranged to substantially cover the luggage handle, the indication to indicate that the identification display is disposed on the inner side of the body portion; and fastening the luggage handle cover around a luggage handle.

* * * * *